US010308889B1

(12) United States Patent
Colucci et al.

(10) Patent No.: US 10,308,889 B1
(45) Date of Patent: Jun. 4, 2019

(54) LUBRICITY ADDITIVES FOR FUELS

(71) Applicant: Afton Chemical Corporation, Richmond, VA (US)

(72) Inventors: William Colucci, Glen Allen, VA (US); Joseph Calderone, Powhatan, VA (US); Joseph Russo, Katy, TX (US)

(73) Assignees: Afton Chemical Corporation, Richmond, CA (US); Shell Oil Company, Houston, TX (US)

( * ) Notice: Subject to any disclaimer, the term of this patent is extended or adjusted under 35 U.S.C. 154(b) by 0 days.

(21) Appl. No.: 16/054,354

(22) Filed: Aug. 3, 2018

(51) Int. Cl.
*C10L 10/08* (2006.01)
*C10L 1/188* (2006.01)
*C10L 1/22* (2006.01)

(52) U.S. Cl.
CPC ..... *C10L 10/08* (2013.01); *C10L 1/1883* (2013.01); *C10L 1/221* (2013.01); *C10L 2200/0259* (2013.01); *C10L 2200/0484* (2013.01)

(58) Field of Classification Search
CPC ..... C10L 2200/0259; C10L 2200/0484; C10L 1/1883; C10L 1/221; C10L 10/08
See application file for complete search history.

(56) References Cited

U.S. PATENT DOCUMENTS 4,680,129 A * 7/1987 Plavac ..... C07D 207/412 508/291
2004/0154218 A1* 8/2004 Watanabe ..... C10L 1/14 44/385
2008/0086936 A1* 4/2008 Cunningham ..... C10L 1/023 44/457
2011/0010985 A1* 1/2011 Hou ..... C10L 1/143 44/347

* cited by examiner

*Primary Examiner* — Taiwo Oladapo
(74) *Attorney, Agent, or Firm* — Honigman LLP

(57) ABSTRACT

Fuel additive compositions that include synergistic mixtures of one or more neutral lubricity additives and one or more monoacidic lubricity additives to provide wear and/or friction reduction in fuels.

27 Claims, 2 Drawing Sheets

LUBRICITY ADDITIVES FOR FUELS

TECHNICAL FIELD

This disclosure is directed to fuel additive compositions that include synergistic mixtures of one or more neutral lubricity additives and one or more monoacidic lubricity additives to provide wear and/or friction reduction in fuel.

BACKGROUND

Fuel compositions for vehicles are continually being improved to enhance various performance properties of the fuels in order to accommodate their use in newer, more advanced engines. Often, improvements in fuel compositions center around improved additives and other components used in the fuel. For example, friction modifiers may be added to fuel to reduce friction and wear in the fuel delivery systems of an engine. Other additives may be included to reduce the corrosion potential of the fuel or to improve the conductivity properties. Still other additives may be blended with the fuel to improve fuel economy. Engine and fuel delivery system deposits represent another concern with modern combustion engines, and therefore other additives often include various deposit control components to regulate and/or mitigate engine deposit problems. Thus, fuel compositions typically include a complex mixture of additives.

SUMMARY

Figure 1:
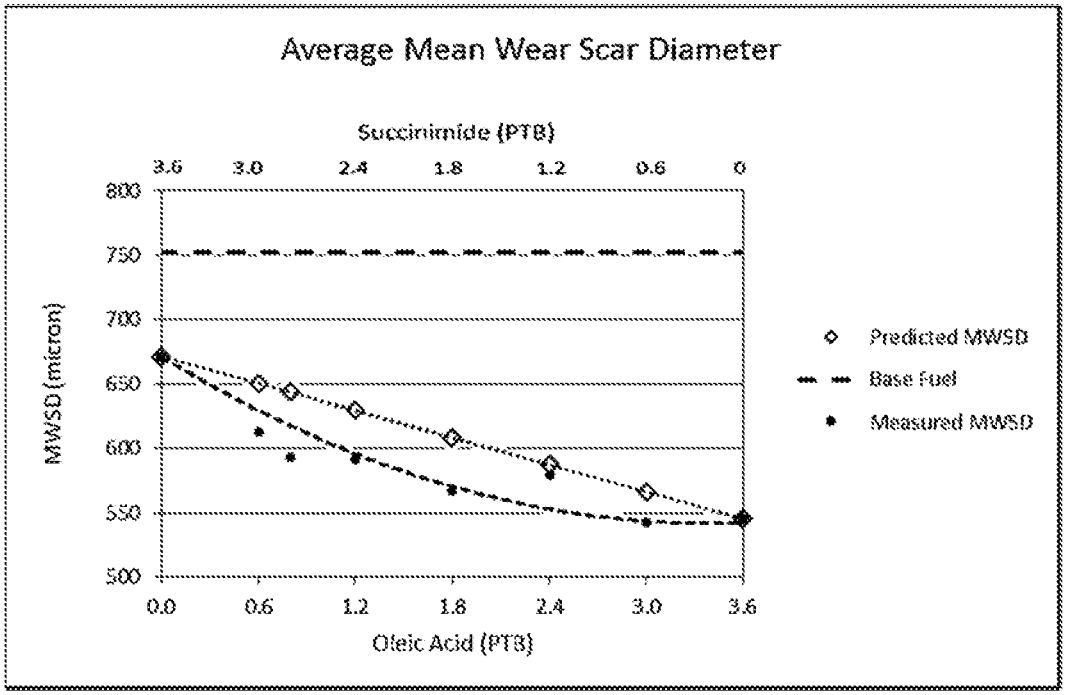
FIG. 1 is a graph showing expected and measured wear scar.

In one approach or embodiment, a gasoline additive providing lubricity is described herein. The gasoline additive includes a lubricity additive mixture of (i) at least one neutral lubricity additive prepared by reacting a hydrocarbyl-substituted polycarboxylic acid compound with ammonia and (ii) at least one linear monocarboxylic acid or salt thereof. The linear monocarboxylic acid or salt thereof is saturated, unsaturated, or including mixtures thereof.

In other embodiments or approaches, the gasoline additive of the previous paragraph may be combined in embodiments or approaches with one or more optional features in any combination. These optional features include any embodiment(s) of wherein a weight ratio of (i) the at least one neutral lubricity additive divided by (ii) the at least one linear monocarboxylic acid or salt thereof is about 0.2 to about 30; and/or wherein the weight ratio is about 2 to about 30; and/or wherein the hydrocarbyl substituent of the polycarboxylic acid compound is a linear or branched C4 to C36 hydrocarbyl group, preferably C8 to C24 hydrocarbyl group, and more preferably C12 to C20 hydrocarbyl group; and/or wherein the hydrocarbyl-substituted polycarboxylic acid compound is a hydrocarbyl-substituted succinic acid, or an anhydride thereof, or a mixture thereof; and/or wherein the at least one linear monocarboxylic acid or salt thereof includes a linear carbon chain having 6 to 24 carbon atoms, preferably 12 to 20 carbon atoms, and more preferably 16 to 18 carbon atoms; and/or wherein the at least one linear monocarboxylic acid or salt thereof is selected from the group consisting of lauric acid, tridecanoic acid, myristic acid, pentadecanoic acid, palmitic acid, margaric acid, stearic acid, arachidic acid, behenic acid, oleic acid, erucic acid, palmitoleic acid, myristoleic acid, linoleic acid, linolenic acid, eleosteric acid, arachidonic acid, coconut oil fatty acid, peanut oil fatty acid, linseed oil fatty acid, palm oil fatty acid, rapeseed oil fatty acid, soybean oil fatty acid, sunflower oil fatty acid, tall oil fatty acid, mixtures thereof, and salts thereof; and/or further comprising a detergent selected from the group consisting of (i) one or more Mannich reaction products formed by condensing a long chain aliphatic hydrocarbon-substituted phenol or cresol with an aldehyde, and an amine, (ii) long chain aliphatic hydrocarbons having an amine or a polyamine attached thereto, (iii) fuel-soluble nitrogen containing salts, amides, imides, succinimides, imidazolines, esters, and long chain aliphatic hydrocarbon-substituted dicarboxylic acids or their anhydrides or mixtures thereof, (iv) polyetheramines; (v) quaternary amines and salts thereof; and (vi) combinations thereof.

In other approaches or embodiments, a fuel is provided comprising a major amount of a spark-ignitable fuel and a minor amount of a lubricity additive mixture. The lubricity additive mixture includes (i) at least one neutral lubricity additive prepared by reacting a hydrocarbyl-substituted polycarboxylic acid with ammonia and (ii) at least one linear monocarboxylic acid or salt thereof. The linear monocarboxylic acid or salt thereof being saturated, unsaturated, or including mixtures thereof.

In other embodiments or approaches, the fuel of the previous paragraph may be combined in embodiments or approaches with one or more optional features in any combination. These optional features include embodiment(s) wherein a weight ratio of (i) the at least one neutral lubricity additive divided by (ii) the at least one linear monocarboxylic acid or salt thereof is about 0.2 to about 30; and/or wherein the weight ratio is about 2 to about 30; and/or wherein a treat rate of the at least one lubricity additive mixture in the fuel is at least about 2 PTB; and/or wherein the hydrocarbyl substituent of polycarboxylic acid is a linear or branched C6 to C36 group; and/or wherein the hydrocarbyl-substituted polycarboxylic acid is a hydrocarbyl-substituted succinic acid or anhydride thereof; and/or wherein the at least one linear monocarboxylic acid or salt thereof includes a linear carbon chain having 6 to 24 carbon atoms; and/or wherein the at least one linear monocarboxylic acid or salt thereof is selected from the group consisting of lauric acid, tridecanoic acid, myristic acid, pentadecanoic acid, palmitic acid, margaric acid, stearic acid, arachidic acid, behenic acid, oleic acid, erucic acid, palmitoleic acid, myristoleic acid, linoleic acid, linolenic acid, eleosteric acid, arachidonic acid, coconut oil fatty acid, peanut oil fatty acid, linseed oil fatty acid, palm oil fatty acid, rapeseed oil fatty acid, soybean oil fatty acid, sunflower oil fatty acid, tall oil fatty acid, mixtures thereof, and salts thereof; and/or further comprising a detergent selected from the group consisting of (i) one or more Mannich reaction products formed by condensing a long chain aliphatic hydrocarbon-substituted phenol or cresol with an aldehyde, and an amine, (ii) long chain aliphatic hydrocarbons having an amine or a polyamine attached thereto, (iii) fuel-soluble nitrogen containing salts, amides, imides, succinimides, imidazolines, esters, and long chain aliphatic hydrocarbon-substituted dicarboxylic acids or their anhydrides or mixtures thereof, (iv) polyetheramines; (v) quaternary amines and salts thereof; and (vi) combinations thereof In yet other approaches or embodiments, a method of reducing wear in a gasoline engine is provided herein or the use of a lubricity additive as described herein to reduce wear in a gasoline engine. The method and/or use includes operating the gasoline engine with a fuel including a major amount of gasoline and a minor amount of a lubricity additive mixture. The lubricity additive mixture includes (i) at least one hydrocarbyl ammonial-succinimide or succinamide neutral lubricity additive and (ii) at least one linear monoacidic lubricity additive or salt thereof.

In other embodiments or approaches, the methods and/or use of the previous paragraph may be combined in embodiments or approaches with one or more optional features in any combination. These optional features include embodiment(s) wherein a weight ratio of (i) the at least one hydrocarbyl ammonial-succinimide or succinamide neutral lubricity additive divided by (ii) the at least one linear monoacidic lubricity additive or salt thereof is about 0.2 to about 30; and/or wherein a treat rate of the lubricity additive mixture in the fuel is at least about 2 PTB; and/or wherein the hydrocarbyl group of the hydrocarbyl ammonial-succinimide or succinamide neutral lubricity additive is a linear or branched C6 to C36 group; and/or wherein the linear monoacidic lubricity additive or salt thereof includes a linear carbon chain having 6 to 24 carbon atoms; and/or wherein the linear monoacidic lubricity additive or salt thereof is selected from the group consisting of lauric acid, tridecanoic acid, myristic acid, pentadecanoic acid, palmitic acid, margaric acid, stearic acid, arachidic acid, behenic acid, oleic acid, erucic acid, palmitoleic acid, myristoleic acid, linoleic acid, linolenic acid, eleosteric acid, arachidonic acid, coconut oil fatty acid, peanut oil fatty acid, linseed oil fatty acid, palm oil fatty acid, rapeseed oil fatty acid, soybean oil fatty acid, sunflower oil fatty acid, tall oil fatty acid, mixtures thereof, and salts thereof; and/or wherein the reduced wear is one of about 15 to about 30 percent reduction in wear scar, about 25 to about 35 percent reduction in friction coefficient, or both as measured by the HFRR test of a modified version of ASTM D6079 described herein using a gasoline conversion kit; and/or wherein the fuel further includes a detergent selected from the group consisting of (i) one or more Mannich reaction products formed by condensing a long chain aliphatic hydrocarbon-substituted phenol or cresol with an aldehyde, and an amine, (ii) long chain aliphatic hydrocarbons having an amine or a polyamine attached thereto, (iii) fuel-soluble nitrogen containing salts, amides, imides, succinimides, imidazolines, esters, and long chain aliphatic hydrocarbon-substituted dicarboxylic acids or their anhydrides or mixtures thereof, (iv) polyetheramines; (v) quaternary amines or salts thereof; and (vi) combinations thereof.

DETAILED DESCRIPTION

In view of the complexity of modern fuel compositions discussed above, there remain challenges when attempting to balance such a multifaceted assortment of additives. For example, some of the conventional fuel additives may be beneficial for one characteristic, but at the same time be detrimental to other fuel characteristics or engine/fuel delivery components. Other fuel additives often require an unreasonably high treat rate to achieve their desired effect, which tends to place undesirable limits on the available amounts of other additives in the fuel composition. In addition, these same additives, when in contact with other additives, may result in a negative response that is not beneficial. Moreover, advancements in engine fuel delivery systems, high pressure direct injection delivery systems, and/or the stress placed on piston rings on modern turbo charged engines tend to heighten the lubricity needs of fuels at a time when fuel compositions are becoming subject to more and more compositional constraints in an attempt to reduce pollution and other undesired effects.

Carboxylic acids and/or fatty acids have long been recognized as effective lubricity additives for fuels. However, such acids, while providing good lubricity, tend to have many shortcoming that may require balancing through other additives, but such further additives tend to drive up costs and cause other problems. For example, many commercially available fatty acids and fatty acid blends tend to freeze or form crystals at temperatures common during winter months. Blending the fatty acids with solvents may improve handling, but solvent addition increases costs, complexity, and treat rate of the additive package. High levels of acid addition to fuels may also result in a number of undesired long-term side effects to engine, motor oil, and fuel system components. For instance, negative effects of high acid levels in fuels may include acid-induced lead leeching from engine bearings and/or terne-plate fuel tanks, crankcase oil sludging, erosion of detergent TBN, soft metal acidic corrosion, or deposit formation often due to unsaturated acids commonly found in some acid blends.

With this background, the present disclosure relates to a fuel additive providing lubricity, fuels including a lubricity additive mixture, methods of reducing engine and fuel delivery system wear using such fuels and such additives, and the use of such fuels and such additives to reduce engine and/or fuel delivery system wear. In some approaches, such wear reduction is achievable even with low levels of acidic lubricity additives in the fuel additive and/or fuels. In one approach, the fuel additive or fuel additive mixture providing lubricity includes at least a lubricity additive mixture of (i) at least one neutral lubricity additive combined with (ii) at least one monoacidic lubricity additive. Such mixture provides an unexpected synergistic benefit in terms of wear and/or friction reduction in fuels because the mixture achieves greater wear reduction and/or lower coefficients of friction than either component in the mixture can achieve individually. Such additive or additive mixture can even achieve levels of wear and friction reduction better than or comparable to additives including much higher levels of acidic additives. In one aspect, the at least one neutral lubricity additive is prepared by reacting a hydrocarbyl-substituted polycarboxylic acid with ammonia, and in another aspect, the at least one monoacidic lubricity additive is a linear monocarboxylic acid, linear fatty acid blend, or mixtures thereof.

The Neutral Lubricity Additive:

In one aspect of this disclosure, the first component (i) of the lubricity additive mixture is at least one neutral lubricity additive prepared by reacting a hydrocarbyl-substituted polycarboxylic acid compound with ammonia. In one approach, the hydrocarbyl-substituted polycarboxylic acid compound is a hydrocarbyl-substituted succinic acid or an anhydride thereof. In other approaches or embodiments, the neutral lubricity additive is an ammonial hydrocarbyl substituted succinimide, an ammonial hydrocarbyl-substituted succinamide, or combination thereof. As used herein the term "succinimide" or "succinamide" is meant to encompass the reaction product between ammonia and a polycarboxylic acid, such as a hydrocarbyl-substituted succinic acid or anhydride (or like succinic acylating agent), and includes compounds wherein the reaction product may have amide, and/or salt linkages in addition to the imide linkage of the type that results from the reaction of or contact with ammonia, and the acid or anhydride moiety.

The succinimides or succinamides may be made by first reacting an olefinically unsaturated hydrocarbon of a desired molecular weight with maleic acid or maleic anhydride (or the like as discussed below) to form a hydrocarbyl-substituted succinic acid or anhydride. Reaction temperatures of about 100° C. to about 250° C. may be used. This reaction is often promoted by the addition of chlorine. Alkenyl succinimides or succinamides in which the succinic group contains a hydrocarbyl substituent containing at least 4 carbon atoms may be useful in the present disclosure and are described for example in U.S. Pat. Nos. 3,172,892; 3,202,678; 3,216,936; 3,219,666; 3,254,025; 3,272,746; 4,234,435; 4,613,341; and 5,575,823, the disclosures of all of which are hereby incorporated by reference.

The hydrocarbyl substituent may include olefins such as, but are not limited to, cracked wax olefins, linear alpha olefins, branched chain alpha olefins, polymers and copolymers of lower olefins. The olefins can be chosen from ethylene, propylene, butylene, such as isobutylene, 1-octane, 1-hexene, 1-decene and the like. Some useful polymers and/or copolymers of lower olefins include, but are not limited to, polypropylene, polybutenes, polyisobutene, ethylene-propylene copolymers, ethylene-isobutylene copolymers, propylene-isobutylene copolymers, ethylene-1-decene copolymers and the like. Hydrocarbyl substituents have also been made from olefin terpolymers. Useful products can be made from ethylene-$C_{3-12}$ alpha olefin-$C_{5-12}$ non-conjugated diene terpolymers; such as ethylene-propylene-1,4-hexadiene terpolymer; ethylenepropylene-1,5-cyclooctadiene terpolymer; ethylene-propylenenorbornene terpolymers and the like.

In one approach or embodiment, the hydrocarbyl substituents may be derived from butene polymers, for example polymers of isobutylene. Suitable polyisobutenes for use in preparing the polycarboxylic acids or anhydrides of the present disclosure can in some embodiments include those polyisobutenes that comprise at least about 20% of the more reactive methylvinylidene isomer, for example at least 50%, and as a further example at least 70%. Suitable polyisobutenes include those prepared using BF3 catalysts. The preparation of such polyisobutenes in which the methylvinylidene isomer comprises a high percentage of the total composition is described in U.S. Pat. Nos. 4,152,499 and 4,605,808, the disclosures of which are hereby incorporated by reference.

The number average molecular weight of the hydrocarbyl substituent may be about 100 to about 2500, for example from about 150 to about 1500, and in other approaches, about 600 to about 1000, as determined by gel permeation chromatography (GPC) using polystyrene as a calibration reference. In yet other approaches, the number average molecular weight of the hydrocarbyl substituent may range from at least about 100, at least about 150, at least about 600, or at least about 900 and no more than about 2500, no more than about 1500, or no more than about 1000. Thus, in some approaches, hydrocarbyl groups of predominantly $C_4$-$C_{36}$ are useful herein with $C_{14}$-$C_{18}$ hydrocarbyl groups being suitable in other approaches. In other approaches, the hydrocarbyl group ranges from at least 4 carbons, at least 6 carbons, at least 8 carbons, at least 10 carbons, at least 12 carbons, at least 14 carbons, or at least 16 carbons and at most 40 carbons, at most 36 carbons, at most 30 carbons, at most 24 carbons, or at most 20 carbons.

The number average molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

Carboxylic reactants other than maleic acid or maleic anhydride can also be employed in some approaches to form the polycarboxylic acid or anhydrides herein. Suitable reactants may also include, but not be limited to, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

The hydrocarbyl-substituted succinic anhydrides or acids may be prepared by the thermal reaction of a polyolefin and maleic anhydride, as described, for example in U.S. Pat. Nos. 3,361,673 and 3,676,089, the disclosures of which are incorporated by reference. Alternatively, the substituted succinic anhydrides can be prepared by the reaction of chlorinated polyolefins with maleic anhydride, as described, for example, in U.S. Pat. No. 3,172,892, the disclosure of which is also incorporated by reference. A further discussion of hydrocarbyl-substituted succinic anhydrides can be found, for example, in U.S. Pat. Nos. 4,234,435; 5,620,486 and 5,393,309, the disclosures of which are incorporated by reference.

In some approaches, a mole ratio of maleic anhydride (or other acylating agent) to the olefinic unsaturated hydrocarbon can vary widely. For example, it can vary from about 5:1 to about 1:5, in other approaches, from about 3:1 to about 1:3, and in yet other approaches, the maleic anhydride can be used in stoichiometric excess to force the reaction to completion. If needed, the unreacted maleic anhydride can be removed by vacuum distillation.

The reaction between the hydrocarbyl-substituted polycarboxylic acid or anhydride and the ammonia to form the neutral lubricity additive can, in one embodiment, be carried out by mixing the components and heating the mixture to a temperature high enough to cause a reaction to occur but not so high as to cause decomposition of the reactants or products or the anhydride may be heated to reaction temperature and the ammonia added over an extended period. A useful temperature is about 100° C. to about 250° C.

Exemplary results can be obtained by conducting the reaction at a temperature high enough to distill out water formed in the reaction.

In some approaches, the neutral lubricity additive described in any of the above paragraphs can be present in the fuel in any desired or effective amount to achieve the synergistic benefits as discussed herein. In some approaches, the neutral lubricity additive can be present in a fuel within an amount ranging from about 0.5 PTB to about 20 PTB (pounds per thousand barrels of fuel), for example from about 3 to about 20 PTB, from about 4 PTB to about 15 PTB, and as a further example from about 5 to about 10 PTB by weight, relative to the total weight of the fuel. Further, the neutral lubricity additive can be present in a fuel within an amount ranging from at least about 0.5 PTB, at least about 3 PTB, at least about 4 PTB, or at least about 5 PTB and at most 20 PTB, at most 15 PTB, or at most 10 PTB.

The neutral lubricity additive discussed in any of the above paragraphs may also be provided within a fuel additive or a fuel additive package together with the monoacidic additive (and other optional ingredients discussed herein). The fuel additive or fuel additive package is configured to be added to a fuel composition. Within this additive package, the neutral lubricity additive may be provided in amounts of about 1 to about 15 weight percent, in other approaches, about 1.5 to about 12 weight percent, and in yet further approaches, about 2 to about 8 weight percent. Further, the neutral lubricity additive can be present in a fuel additive or fuel additive package in an amount ranging from at least about 1 weight percent, at least about 1.5 weight percent, or at least about 2 weight percent and at most 15 weight percent, at most 12 weight percent, or at most 8 weight percent.

The Monoacidic Lubricity Additive:

In another aspect of this disclosure, the second component (ii) of the lubricity additive mixture is a linear monoacidic lubricity additive or salt thereof. In some approaches or embodiments, the linear monoacidic additive is a linear monocarboxylic acid, a linear fatty acid, blends thereof, and/or salts thereof. In some approaches or embodiments, the linear monocarboxylic acid or linear fatty acid blend includes linear carbon chain(s) having 6 to 40 carbon atoms, typically 8 to 24 carbon atoms, and in other approaches, about 12 to about 20 carbon atoms. In other approaches, the linear monocarboxylic acid or the linear fatty acid blend includes linear carbon chain(s) with a number of carbon atoms ranging from at least 6, at least 8, or at least 12 and at most 40, at most 24, or at most 20. The acids, often saturated, can also contain one or more carbon-carbon double bonds, and the acids can be of natural origin, synthetic origin, or combinations thereof.

The hydrocarbyl radicals (preferably alkyl radicals) of the monocarboxylic acids or fatty acids are linear, saturated or unsaturated, carbon chains of preferably only straight chains with carbon and hydrogen. However, the acids may include optional substituents such as for example hydroxyl, hydrogen, amino or nitro groups, provided any substitution does not impair the predominant hydrocarbon character of the linear carbon chain.

In some approaches or embodiments, useful linear monocarboxylic acids, or linear fatty acids, include for example lauric acid, tridecanoic acid, myristic acid, pentadecanoic acid, palmitic acid, margaric acid, stearic acid, arachidic acid, behenic acid, oleic acid, erucic acid, palmitoleic acid, myristoleic acid, linoleic acid, linolenic acid, eleosteric acid and arachidonic acid, ricinoleic acid and also fatty acid mixtures obtained from natural fats and oils, for example coconut oil fatty acid, peanut oil fatty acid, linseed oil fatty acid, palm oil fatty acid, rapeseed oil fatty acid, castor oil fatty acid, colza oil fatty acid, soybean oil fatty acid, sunflower oil fatty acid, and tall oil fatty acid (TOFA), salts thereof, or mixtures thereof. In some approaches or embodiments, the linear monocarboxylic acid, fatty acid, or blend includes or is oleic acid, TOFA, lauric acid, salts thereof, or mixtures thereof.

In some approaches, the linear monoacidic lubricity additive or salt thereof can be present in the fuel in any desired or effective amount to achieve the synergistic benefits as discussed herein. In some approaches, the linear monoacidic lubricity additive can be present in the fuel in amounts ranging from about 0.05 PTB to about 2 PTB, for example from about 0.1 PTB to about 1 PTB, in other approaches, about 0.1 PTB to about 0.4 PTB, and as a further example from about 0.1 to about 0.3 PTB by weight, relative to the total weight of the fuel. Further, the linear monoacidic lubricity additive can be present in a fuel within an amount ranging from at least about 0.05 PTB, at least about 0.1 PTB, at least about 0.2 PTB, or at least about 0.3 PTB and at most 3 PTB, at most 1 PTB, at most 0.5 PTB, or at most 0.25 PTB.

In other approaches, the linear monoacidic lubricity additive or salt thereof may also be provided within a separate fuel additive or fuel additive package together with the neutral lubricity additive described above (and other optional ingredients) that is configured to be added to a fuel composition. Within this additive package, the linear monoacidic lubricity additive or salt thereof may be provided in amounts of about 0.05 to about 2 weight percent, in other approaches, about 0.1 to about 1 weight percent, in yet further approaches, about 0.1 to about 0.4 percent, and in yet further approaches, about 0.15 to about 0.3 weight percent. Further, the linear monoacidic lubricity additive can be present in a fuel additive or fuel additive package in an amount ranging from at least about 0.05 weight percent, at least about 0.1 weight percent, or at least about 0.15 weight percent and at most 2 weight percent, at most 1 weight percent, at most 0.4 weight percent, or at most 0.3 weight percent.

The Lubricity Additive Mixture:

The lubricity additive mixture (and/or any fuel including such mixtures) includes one or more of the above described neutral lubricity additives and one or more of the above described monoacidic lubricity additives and may include other optional additives as discussed below. The two components of this mixture are provided in amounts and relative ratios thereof that unexpectedly achieve a greater wear and friction reduction to an engine and/or fuel delivery system than either additive can achieve individually. In approaches, the lubricity additive mixture may achieve wear reduction and friction coefficient better than or comparable to additives or fuels including much higher levels of acids. In one approach, the lubricity additive mixture and/or fuel is an unreacted mixture of the two components and, in some approaches, substantially free of any reaction product therebetween, such as any amide reaction product of amines and monoacid. As shown in the Examples below, this synergistic mixture of the two components provides a thicker and slicker fuel additive by achieving a thick film coverage on engine or fuel components tending to result in an unexpectedly high wear reduction and lower coefficient of friction than either component can achieve individually relative to treat rates in the fuel. As discussed more below in the Examples, wear and friction reduction is measured using a High Frequency Reciprocating Rig (HFFR) per a modified version of ASTM D6079 using a gasoline conversion kit available from PCS Instruments (London, UK). The modified test uses a sample cup having a lid to prevent volatility. The sample volume was 15 mL and the sample temperature was held at 25° C. Film coverage was measured on a Quartz Crystal Microbalance (QCM).

In one approach, a synergistic lubricity weight ratio of the (i) the one or more neutral lubricity additive(s) as described above divided by (ii) the one or more linear monocarboxylic acid(s) or salt(s) thereof as described above in the fuel and/or within a fuel additive is about 0.2 to about 30 to achieve the unexpected lubricity of the mixtures as discussed herein. In yet other approaches, this synergistic lubricity weight ratio is about 2 to about 30, about 5 to about 30, about 10 to about 30, or about 20 to about 30. In other approaches or embodiments, the synergistic lubricity weight ratio ranges from at least about 2, at least about 5, at least about 10, or at least about 20 to at most 30, at most 25, at most 20, or at most 15.

In yet other approaches or embodiments, a treat rate of the lubricity additive mixture (that is, the combination of the neutral lubricity additive and linear monocarboxylic acid or salt thereof within the synergistic weight ratios as described above) in a fuel (preferably gasoline) may be at least about 2 pounds per thousand barrels of fuel (PTB), in other approaches, at least about 5 PTB, and in yet other approaches, at least about 9 PTB. In further approaches or embodiments, the treat rate of the lubricity additive mixtures (that is again, the combination of the neutral lubricity additive and the linear monocarboxylic acid or salt thereof within the synergistic weight ratios described above) in the fuel may be about 2 to about 90 PTB, about 2 to about 50 PTB, about 2 to about 30 PTB, about 2 to about 20 PTB, about 2 to about 10 PTB, about 5 to about 90 PTB, about 5 to about 50 PTB, about 5 to about 30 PTB, about 5 to about 20 PTB, about 5 to about 10 PTB, about 9 to about 90 PTB, about 9 to about 50 PTB, or about 9 to about 30 PTB, or about 9 to about 20 PTB. In further approaches, the treat rate of the lubricity additive mixture is an amount ranging from at least about 2 PTB, at least about 5 PTB, or at least about 9 PTB and at most 90 PTB, at most 50 PTB, at most 20 PTB, or at most 10 PTB.

The lubricity additive mixtures may achieve a wear reduction (as compared to un-additized base fuel without any additives) in terms of wear scar about 15 to about 30 percent lower as measured by HFRR per a modified version of ASTM D6079 using a gasoline conversion kit. In other approaches, wear reduction (compared to an un-additized base fuel) in terms of wear scar ranges from at least 5% lower, at least 10% lower, or at least 15% lower and at most 35% lower, at most 25% lower, or at most 20% lower. In other instances, a friction coefficient is improved (as compared to un-additized base fuel without any additives) of about 25 to about 35 percent lower as measured by HFRR per a modified version of ASTM D6079 using a gasoline conversion kit. In other approaches, friction coefficient reductions (compared to an un-additized fuel) ranges from at least 25% lower, at least 30% lower to at most 35% lower, or at least 30% lower.

The lubricity fuel additive mixtures herein may be part of an overall fuel additive package or fuel additive composition that may further include other additive components, such as at least a detergent package or core detergent system in combination with the lubricity additive mixtures as discussed in any of the above paragraphs. In one approach or embodiment, a suitable detergent package that may be used along with any of the lubricity additive mixtures discussed herein may include one or more detergents, carriers, solvents, and/or dispersants as needed for a particular application. In some approaches, the one or more detergents may be selected from the group consisting of (i) one or more Mannich reaction products formed by condensing a long chain aliphatic hydrocarbon-substituted phenol or cresol with an aldehyde, and an amine, (ii) long chain aliphatic hydrocarbons having an amine or a polyamine attached thereto, (iii) fuel-soluble nitrogen containing salts, amides, imides, succinimides, imidazolines, esters, and long chain aliphatic hydrocarbon-substituted dicarboxylic acids or their anhydrides or mixtures thereof, (iv) polyetheramines; (v) quaternary amines and salts thereof; and (vi) combinations thereof. If included, the fuel additive may include about 20 to about 40% of the detergent so that a fuel may include about 35 to about 75 PTB detergent in the fuel.

If included, the carrier or carrier fluid may be a hydrocarbon oil having a viscosity less than or equal to about 200 cSt (at 40° C.) and/or greater than about 90% saturates. Other carrier fluids or oils may also include but, not limited to, one or more liquid poly-alpha-olefin oligomers, liquid poly(oxyalkylene) compounds, liquid alcohols and/or polyols, polyalkenes, polyethers, liquid esters, less-refined mineral oils, and mixtures thereof. Liquid carriers may also include one or more polyalkyl-substituted hydroxyaromatic compounds. Less-refined mineral oil ancillary carriers that may be utilized in an embodiment include paraffinic, naphthenic and asphaltic oils, derived from various petroleum crude oils and processed in any suitable manner, used alone or in combination with any other suitable co-carrier. If included, the fuel additive may include about 5 to about 30 weight percent of the carrier so that a fuel may include about 5 to about 70 PTB carrier in the fuel.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); (3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 weight percent, for example from about 80 to about 98 weight percent relative to the total weight of the composition. For examples, a major amount may be an amount ranging from at least 50 weight percent, at least about 60 weight percent, at least about 70 weight percent, or at least about 80 weight percent and no more than about 98 weight percent, no more than 90 weight percent, no more than 80 weight percent, or no more than 70 weight percent. Moreover, as used herein, the term "minor amount" is understood to mean an amount less than 50 weight percent relative to the total weight of the composition. In other examples, a minor amount is an amount ranging from at least about 0.1 weight percent, at least about 1 weight percent, at least about 10 weight percent, or at least about 20 weight percent and no more than 49 weight percent, no more than 40 weight percent, no more than 30 weight percent, no more than 20 weight percent or no more than 10 weight percent.

As used herein, the term "olefin copolymer" refers to a random and/or block polymer comprised of two or more different types of monomers, wherein all monomers contain at least one olefin (carbon-carbon double bond).

For purposes of this disclosure, the chemical elements are identified in accordance with the Periodic Table of the Elements, CAS version, Handbook of Chemistry and Physics, 75th Ed. Additionally, general principles of organic chemistry are described in "Organic Chemistry", Thomas Sorrell, University Science Books, Sausolito: 1999, and "March's Advanced Organic Chemistry", 5th Ed., Ed.: Smith, M. B. and March, J., John Wiley & Sons, New York: 2001, the entire contents of which are hereby incorporated by reference.

As used herein the term "aliphatic" encompasses the terms alkyl, alkenyl, alkynyl, each of which being optionally substituted as set forth below.

As used herein, an "alkyl" group refers to a saturated aliphatic hydrocarbon group containing, unless otherwise specified herein, 1 to 12 (e.g., 1 to 8, 1 to 6, or 1 to 4) carbon atoms. An alkyl group can be, unless otherwise noted herein, straight or branched. Examples of alkyl groups include, but are not limited to, methyl, ethyl, propyl, isopropyl, butyl, isobutyl, sec-butyl, tert-butyl, n-pentyl, n-heptyl, or 2-ethylhexyl. An alkyl group can be substituted (i.e., optionally substituted) with one or more substituents such as halo, phospho, cycloaliphatic [e.g., cycloalkyl or cycloalkenyl], heterocycloaliphatic [e.g., heterocycloalkyl or heterocycloalkenyl], aryl, heteroaryl, alkoxy, aroyl, heteroaroyl, acyl [e.g., (aliphatic)carbonyl, (cycloaliphatic)carbonyl, or (heterocycloaliphatic)carbonyl], nitro, cyano, amido [e.g., (cycloalkylalkyl)carbonylamino, arylcarbonylamino, aralkylcarbonylamino, (heterocycloalkyl)carbonylamino, (heterocycloalkylalkyl) carbonylamino, heteroarylcarbonylamino, heteroaralkylcarbonylamino alkylaminocarbonyl, cycloalkylaminocarbonyl, heterocycloalkylaminocarbonyl, arylaminocarbonyl, or heteroarylaminocarbonyl], amino [e.g., aliphaticamino, cycloaliphaticamino, or heterocycloaliphaticamino], sulfonyl [e.g., aliphatic-$SO_2$—], sulfinyl, sulfanyl, sulfoxy, urea, thiourea, sulfamoyl, sulfamide, oxo, carboxy, carbamoyl, cycloaliphaticoxy, heterocycloaliphaticoxy, aryloxy, heteroaryloxy, aralkyloxy, heteroarylalkoxy, alkoxycarbonyl, alkylcarbonyloxy, or hydroxy. Without limitation, some examples of substituted alkyls include carboxyalkyl (such as HOOC-alkyl, alkoxycarbonylalkyl, and alkylcarbonyloxyalkyl), cyanoalkyl, hydroxyalkyl, alkoxyalkyl, acylalkyl, aralkyl, (alkoxyaryl)alkyl, (sulfonylamino)alkyl (such as (alkyl-$SO_2$-amino) alkyl), aminoalkyl, amidoalkyl, (cycloaliphatic)alkyl, or haloalkyl.

As used herein, an "alkenyl" group refers to an aliphatic carbon group that contains, unless otherwise specified herein 2 to 8 (e.g., 2 to 12, 2 to 6, or 2 to 4) carbon atoms and at least one double bond. Like an alkyl group, an alkenyl group can be, unless otherwise noted herein straight or branched. Examples of an alkenyl group include, but are not limited to allyl, isoprenyl, 2-butenyl, and 2-hexenyl. An alkenyl group can be optionally substituted with one or more substituents such as halo, phospho, cycloaliphatic [e.g., cycloalkyl or cycloalkenyl], heterocycloaliphatic [e.g., heterocycloalkyl or hetero cycloalkenyl], aryl, heteroaryl, alkoxy, aroyl, heteroaroyl, acyl [e.g., (aliphatic) carbonyl, (cycloaliphatic) carbonyl, or (heterocycloaliphatic)carbonyl], nitro, cyano, amido [e.g., (cycloalkylalkyl)carbonylamino, arylcarbonylamino, aralkylcarbonylamino, (hetero cycloalkyl) carbonylamino, (heterocycloalkylalkyl)carbonylamino, heteroarylcarbonylamino, heteroaralkylcarbonylamino alkylaminocarbonyl, cycloalkylaminocarbonyl, hetero cyclo alkylaminocarbonyl, arylaminocarbonyl, or heteroarylaminocarbonyl], amino [e.g., aliphaticamino, cycloaliphaticamino, heterocycloaliphaticamino, or aliphaticsulfonylamino], sulfonyl [e.g., alkyl-$SO_2$—, cycloaliphatic-$SO_2$—, or aryl-$SO_2$—], sulfinyl, sulfanyl, sulfoxy, urea, thiourea, sulfamoyl, sulfamide, oxo, carboxy, carbamoyl, cycloaliphaticoxy, heterocycloaliphaticoxy, aryloxy, heteroaryloxy, aralkyloxy, heteroaralkoxy, alkoxycarbonyl, alkylcarbonyloxy, or hydroxy. Without limitation, some examples of substituted alkenyls include cyanoalkenyl, alkoxyalkenyl, acylalkenyl, hydroxyalkenyl, aralkenyl, (alkoxyaryl)alkenyl, (sulfonylamino)alkenyl (such as (alkyl-$SO_2$-amino)alkenyl), aminoalkenyl, amidoalkenyl, (cycloaliphatic)alkenyl, or haloalkenyl.

Other Additives

One or more optional compounds may be present in the additive and/or fuel compositions of the disclosed embodiments. For example, the additives and/or fuels may contain conventional quantities of cetane improvers, octane improvers, corrosion inhibitors, cold flow improvers (CFPP additive), pour point depressants, solvents, demulsifiers, lubricity additives, friction modifiers, amine stabilizers, combustion improvers, detergents, dispersants, antioxidants, heat stabilizers, conductivity improvers, metal deactivators, marker dyes, organic nitrate ignition accelerators, cycloaromatic manganese tricarbonyl compounds, carrier fluids, and the like. In some aspects, the compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, 2-ethylhexanol, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

Suitable optional cycloaromatic manganese tricarbonyl compounds which may be employed in the compositions of the present application include, for example, cyclopentadienyl manganese tricarbonyl, methylcyclopentadienyl manganese tricarbonyl, indenyl manganese tricarbonyl, and ethylcyclopentadienyl manganese tricarbonyl. Yet other examples of suitable cycloaromatic manganese tricarbonyl compounds are disclosed in U.S. Pat. Nos. 5,575,823 and 3,015,668, both of which are incorporated by reference in their entirety.

Other commercially available detergents and/or additives may be used in combination with the reaction products described herein. Such detergents include but are not limited to succinimides, Mannich base detergents, quaternary ammonium compounds, bis-aminotriazole detergents as generally described in U.S. patent application Ser. No. 13/450,638, and a reaction product of a hydrocarbyl substituted dicarboxylic acid, or anhydride and an aminoguanidine, wherein the reaction product has less than one equivalent of amino triazole group per molecule as generally described in U.S. patent application Ser. Nos. 13/240,233 and 13/454,697.

The additives of the present application, including the lubricity additive mixtures as described above, and any optional additives used in formulating the fuels of this disclosure may be blended into a base fuel individually or in various sub-combinations. In some embodiments, the additive components of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

Base Fuels

The fuels of the present application may be applicable to the operation of diesel, jet, or gasoline engines. In one approach, the lubricity additive mixtures herein are well suited for diesel or gasoline and, particularly, gasoline. In one embodiment, the fuel is gasoline. In other another embodiment, the fuel is a diesel. The fuels may include any and all middle distillate fuels, diesel fuels, biorenewable fuels, biodiesel fuel, fatty acid alkyl ester, gas-to-liquid (GTL) fuels, gasoline, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. "Biorenewable fuels" as used herein is understood to mean any fuel which is derived from resources other than petroleum. Such resources include, but are not limited to, corn, maize, soybeans and other crops; grasses, such as switchgrass, *miscanthus*, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, isoamyl alcohol, and mixtures thereof. Preferred fuels include gasoline fuels.

The fuels herein are suitable for use in various internal combustion systems or engines. The systems or engines may include both stationary engines (e.g., engines used in electrical power generation installations, in pumping stations, etc.) and ambulatory engines (e.g., engines used as prime movers in automobiles, trucks, road-grading equipment, military vehicles, etc.). By combustion system or engine herein is meant, internal combustion engines, for example and not by limitation, Atkinson cycle engines, rotary engines, spray guided, wall guided, and the combined wall/spray guided direct injection gasoline ("DIG" or "GDI") engines, turbocharged DIG engines, supercharged DIG engines, homogeneous combustion DIG engines, homogeneous/stratified DIG engines, DIG engines outfitted with piezoinjectors with capability of multiple fuel pulses per injection, DIG engines with EGR, DIG engines with a lean-NOx trap, DIG engines with a lean-NOx catalyst, DIG engines with SN—CR NOx control, DIG engines with exhaust diesel fuel after-injection (post combustion) for NOx control, DIG engines outfitted for flex fuel operation (for example, gasoline, ethanol, methanol, biofuels, synthetic fuels, natural gas, liquefied petroleum gas (LPG), and mixtures thereof.) Also included are conventional and advanced port-fueled internal combustion engines, with and without advanced exhaust after-treatment systems capability, with and without turbochargers, with and without superchargers, with and without combined supercharger/turbocharger, with and without on-board capability to deliver additive for combustion and emissions improvements, and with and without variable valve timing. Further included are gasoline fueled homogeneous charge compression ignition (HCCI) engines, diesel HCCI engines, two-stroke engines, diesel fuel engines, gasoline fuel engines, stationary generators, gasoline and diesel HCCI, supercharged, turbocharged, gasoline and diesel direct injection engines, engines capably of variable valve timing, leanburn engines, engines capable of inactivating cylinders or any other internal combustion engine. Still further examples of combustion systems include any of the above-listed systems combined in a hybrid vehicle with an electric motor.

EXAMPLES

The following examples are illustrative of exemplary embodiments or approaches of the disclosure. In these examples, as well as elsewhere in this disclosure, all ratios, parts, and percentages are by weight unless otherwise indicated. It is intended that these examples are being presented for the purpose of illustration only and are not intended to limit the scope of the invention disclosed herein.

Example 1

An experiment was conducted to evaluate wear scar and friction coefficient of various individual lubricity additives and lubricity additive mixtures within a commercially available Tier 3 E10 gasoline using a High Frequency Reciprocating Rig (HFRR) according to a modified version of ASTM D6079 using a gasoline conversion kit available from PCS instruments (London, UK). Procedures for using the HFRR with the gasoline conversion kit are provided in The Lubricity of Gasoline, D. P. Wei, H. A. Spikes & S. Koreck, Tribology Transactions, 42:4 813-823 (1999), which is incorporated herein by reference.

In this experiment, the E10 gasoline was first run to determine a base line for wear scar and friction coefficient with no additives. Then, various comparative and inventive lubricity additives and lubricity additive mixtures were evaluated as shown Table 1 below. The lubricity ratio was the neutral lubricity additive (in this case a C8-ASA-NH) divided by the monoacidic lubricity additive (in this case oleic acid).

TABLE 1

| HFRR Evaluations | | | | | | |
|---|---|---|---|---|---|---|
| Run | Fuel | Oleic Acid, PTB | C8-ASA-NH, PTB | Lubricity Ratio | Average Wear Scar, microns | Average Friction Coefficient |
| 1 | E10 gasoline | — | — | — | 752 | 0.433 |
| 2 | E10 gasoline | 3.6 | — | — | 545 | 0.325 |
| 3 | E10 gasoline | — | 3.6 | — | 671 | 0.322 |
| 4 | E10 gasoline | 0.6 | 3.0 | 5 | 613 | 0.318 |
| 5 | E10 gasoline | 0.8 | 2.8 | 3.5 | 593 | 0.312 |
| 6 | E10 gasoline | 1.2 | 2.4 | 2 | 591 | 0.308 |
| 7 | E10 gasoline | 1.8 | 1.8 | 1 | 555 | 0.304 |
| 8 | E10 gasoline | 2.4 | 1.2 | 0.5 | 579 | 0.316 |
| 9 | E10 gasoline | 3.0 | 0.6 | 0.2 | 542 | 0.302 |

Table 2 below demonstrates the unexpected synergistic benefit of the inventive lubricity additive mixtures (runs 4 to 9) including unreacted combinations of oleic acid (a linear monocarboxylic acid) and C8-ASA-NH (a neutral lubricity additive in the form of a C8 hydrocarbyl ammonia succinimide). The synergy was evidenced by comparing the predicted wear scar relative to the measured wear scar. The predicted wear scar was calculated based on the wear scar of each additive individually (that is, runs 2 or 3) and the weight percent of each additive individually and summed up (that is, for example, the predicted wear scar of Run 4 was determined as follows: 0.6/3.6(545)+3.0/3.6 (671)=650). The predicted wear scar represents the expected result of a combination of lubricity additives in the E10 gasoline based on each individual additive treat rate. As the measured wear scar was better (that is, lower) than the expected result, an unexpected synergistic benefit was provided by the inventive samples as shown by the synergistic improvement in Table 2 below.

TABLE 2

| Wear Scar Synergy | | | |
|---|---|---|---|
| Run | Measured Average Wear Scar, microns | Predicted Wear Scar, microns | Synergistic Improvement, microns |
| 4 | 613 | 650 | −37 |
| 5 | 593 | 643 | −50 |
| 6 | 591 | 629 | −38 |
| 7 | 567 | 608 | −53 |
| 8 | 579 | 587 | −8 |
| 9 | 542 | 566 | −24 |

Figure 2:
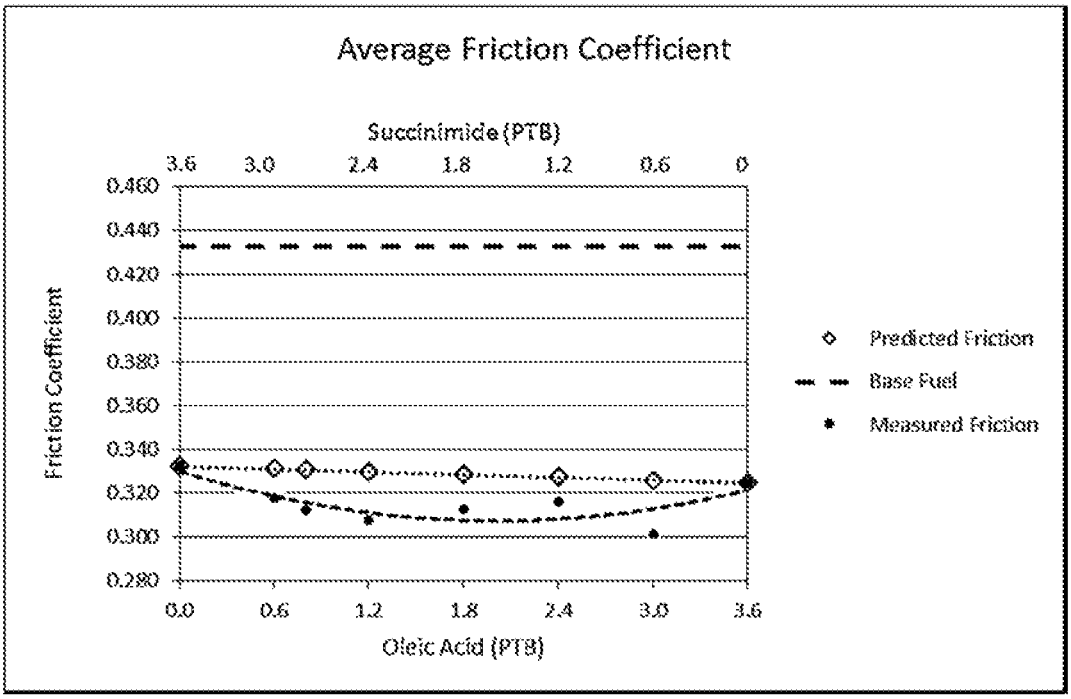
FIG. 2 is a graph showing expected and measured friction coefficient.

As shown in Table 2 above, the inventive mixtures of oleic acid and C8-ASA-NH (at a combined treat rate of 3.6 PTB and a lubricity weight ratio ranging from about 0.2 to about 5) each achieved an unexpectedly better (i.e., lower) wear scar well beyond the expected or predicted wear scar. This synergy is further shown in the graph of FIG. 1 with the measured wear scar curve lower than the predicted wear scar line for the tested samples. Lower wear scar is better. Table 3 below shows a similar synergistic improvement in friction coefficient. This unexpected synergistic improvement in friction coefficient is also shown in the graph of FIG. 2 with a similar synergistic curve showing the measured friction coefficient curve below the predicted friction coefficient curve.

TABLE 3

| Friction Coefficient Synergy | | | |
|---|---|---|---|
| Run | Measured Average Friction Coefficient | Predicted Friction Coefficient | Synergistic Benefit of Inventive samples |
| 4 | 0.318 | 0.331 | −0.013 |
| 5 | 0.312 | 0.331 | −0.019 |
| 6 | 0.308 | 0.330 | −0.022 |
| 7 | 0.312 | 0.329 | −0.017 |
| 8 | 0.316 | 0.327 | −0.011 |
| 9 | 0.302 | 0.326 | −0.024 |

Example 2

A further evaluation was conducted to measure the ability of the comparative and inventive lubricity additives and lubricity additive mixtures with respect to film formability in an E10 surrogate fuel using the neutral lubricity additive and the linear monoacidic lubricity additives of Example 1. Evaluations were conducted using a quartz crystal microbalance (QCM).

For these experiments, the QCM evaluations were performed on a Q-Sense QCM-D instrument manufactured by Biolin Scientific. Stainless steel SS2343 coated sensor discs manufactured by Biolin Scientific (Batch 17E161) were used in the instrument (Biolin Part No. QSX304). The E10 surrogate fuel was about 90% HPLC grade isooctane and about 10% absolute ethanol (ACS Reagent Grade 99.5+%) and degassed with helium. The E10 surrogate fuel was run at a flow rate of about 150 μL/min by itself as a baseline or additized with different ratios of oleic acid and succinimide of Example 1. Adsorption experiments were performed by equilibrating the sensor disc on the E10 surrogate fuel for about 10 minutes. The experiment was started and a baseline was collected on the E10 surrogate fuel for about 2 minutes. The E10 surrogate fuel was then replaced with the additized fuel of Table 4 and adsorption data was collected for approximately 30 minutes. The adsorbed mass and dissipation were determined at 25 minutes after additized fuel introduction (at this point the film has reached equilibrium adsorption with the surface).

The piezoelectric effect is the underlying principle that the QCM test protocol is based on. In the testing, an electrical potential was applied to an AT-cut quartz sensor disc. The AT-cut ensures the quartz disc oscillates at a repeatable frequency over a wide temperature range. One side of the quartz sensor disc was coated with gold electrodes to allow electrical current to pass through the quartz. The other side of the disc, the test side, was coated with different materials, and for the testing of this Example, was Stainless Steel 2343. The test side of the disc was mounted such that a fluid can pass over the disc. A peristaltic pump ancillary to the QCM instrument pulled fluid from a sample vessel through the test cell containing the sensor disc into a waste container. As fluid was pulled over the test side of the sensor disc, any surface active component will adsorb to the surface. This mass change induces a frequency change, which is logged by the QCM instrument. Application of the Sauerbrey equation, which is completed by the software provided on the QCM instrument, converted this frequency change to a change in mass. Another measurement provided by the QCM was dissipation, which measures the rate of energy loss when the electrical potential to the disc is briefly shut off. Shutting off the potential driving the disc will cause its oscillation frequency to decay. The presence of different types of molecules adhered to the surface can impact the rate of oscillation frequency decay and hence the dissipation value. The dissipation value provides information about the type and properties of the film adsorbed to the surface.

Figure 3:
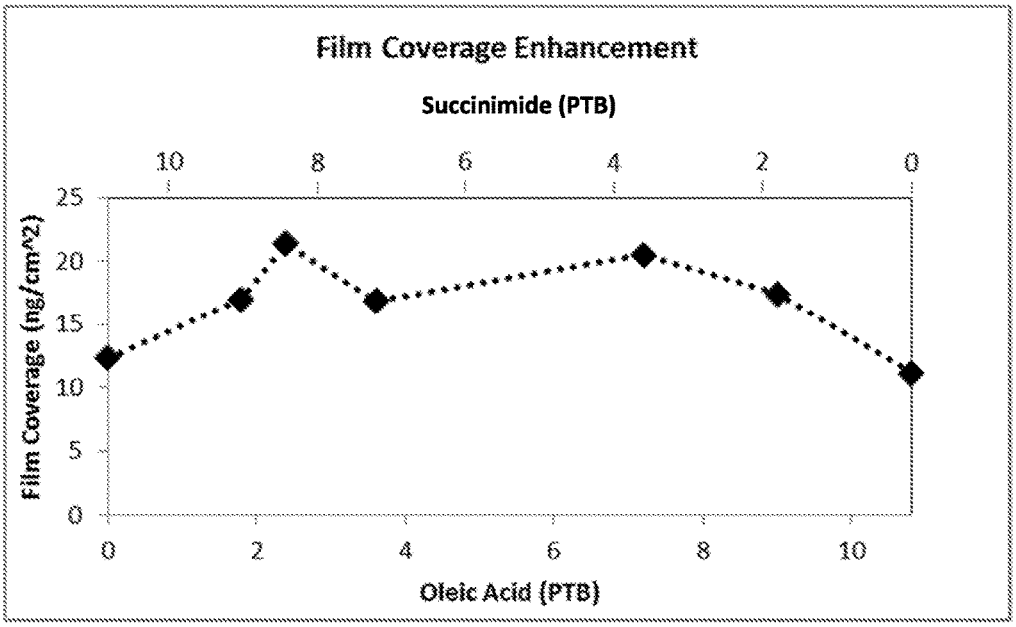
FIG. 3 is a graph showing measured Quartz Crystal Microbalance (QCM) film surface coverage.
Figure 4:
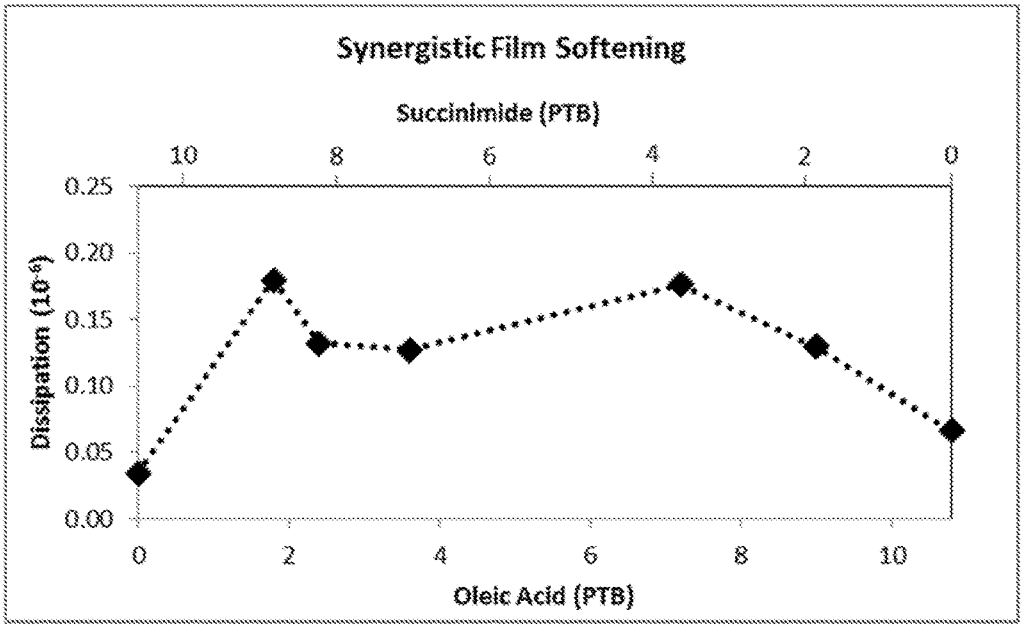
FIG. 4 is a graph showing measured QCM dissipation energy.

In this experiment, the samples from Example 1 were evaluated using the QCM protocol and as shown in Table 4 below and also shown in FIGS. 3 and 4.

TABLE 4

| QCM Evaluations | | | | | | | |
|---|---|---|---|---|---|---|---|
| | Oleic | C8- | Lubricity | Film Coverage at Equilibrium (25 min) ng/cm$^2$ | | Dissipation at Equilibrium (25 min) 1E−6 | |
| Run | Acid | ASA-NH | Ratio | Avg | Std Dev | Avg | Std Dev |
| 10 | 0 | 10.8 | — | 12.3 | 4.3 | 0.034 | 0.020 |
| 11 | 1.8 | 9 | 5 | 17.0 | 0.5 | 0.180 | 0.025 |
| 12 | 2.4 | 8.4 | 3.5 | 21.4 | 6.9 | 0.132 | 0.017 |
| 13 | 3.6 | 7.2 | 2 | 16.9 | 4.0 | 0.127 | 0.019 |
| 14 | 7.2 | 3.6 | 0.5 | 20.5 | 5.6 | 0.176 | 0.027 |
| 15 | 9 | 1.8 | 0.2 | 17.4 | 2.4 | 0.130 | 0.017 |
| 16 | 10.8 | 0 | — | 11.1 | 3.2 | 0.066 | 0.012 |

Similar to Example 1, the synergistic benefit of the inventive samples (runs 11 to 15) was compared to a predicted film coverage and dissipation calculated similar to the predicted results in Example 1. This synergy is shown in Table 5 below and in FIGS. 3 and 4.

TABLE 5

| QCM Synergy—Film Coverage and Dissipation | | | | | | |
|---|---|---|---|---|---|---|
| Run | Predicted Film coverage | Measured Film Coverage | Synergistic Benefit, ng/cm$^2$ | Predicted Dissipation | Measured Dissipation | Synergistic Benefit, 1E−6 |
| 11 | 12.1 | 17.0 | +4.9 | 0.040 | 0.180 | +0.140 |
| 12 | 12.1 | 21.4 | +9.3 | 0.043 | 0.132 | +0.091 |
| 13 | 11.9 | 16.9 | +4.9 | 0.045 | 0.127 | +0.082 |
| 14 | 11.5 | 20.5 | +9.0 | 0.056 | 0.176 | +0.120 |
| 15 | 11.3 | 17.4 | +6.1 | 0.061 | 0.130 | +0.069 |

The inventive samples all had a thicker film coverage than expected and a higher dissipation than expected, which is evidence the mixtures provide better lubricity.

Example 3

Wear scar and friction coefficient were evaluated consistent with the procedures of Example 1 except using linear monoacidic lubricity additives of either oleic acid or tall oil fatty acid. The neutral lubricity additive for this Example was an olefin ammonial succinimide that includes predominately C16 to C18 ammonial succinimides (Afton HiTEC®4897). The results are shown in Table 6 below. The lubricity ratio is the neutral lubricity additive divided by the acidic lubricity additive (either oleic acid or TOFA)

TABLE 6

| HFRR Evaluations | | | | | | | |
|---|---|---|---|---|---|---|---|
| Run | Fuel | Oleic Acid, PTB | TOFA, PTB | C16-C18-ASA-NH, PTB | Lubricity Ratio | Average Wear Scar, microns | Average Friction Coefficient |
| 16 | E10 Gasoline | — | — | — | — | 733 | 0.450 |
| 17 | E10 Gasoline | — | — | 2.8 | — | 668 | 0.394 |
| 18 | E10 Gasoline | — | — | 3.6 | — | 659 | 0.383 |
| 19 | E10 Gasoline | 0.8 | — | — | — | 761 | 0.412 |
| 20 | E10 Gasoline | 3.6 | — | — | — | 571 | 0.356 |

TABLE 6-continued

| HFRR Evaluations | | | | | | | |
|---|---|---|---|---|---|---|---|
| Run | Fuel | Oleic Acid, PTB | TOFA, PTB | C16-C18-ASA-NH, PTB | Lubricity Ratio | Average Wear Scar, microns | Average Friction Coefficient |
| 21 | E10 Gasoline | 0.8 | — | 2.8 | 3.5 | 593 | 0.350 |
| 22 | E10 Gasoline | — | 0.8 | — | — | 731 | 0.377 |
| 23 | E10 Gasoline | — | 3.6 | — | — | 577 | 0.343 |
| 24 | E10 Gasoline | — | 0.8 | 2.8 | 3.5 | 657 | 0.359 |

Inventive run 21 evidenced a synergistic benefit because it achieved a wear scar and a friction coefficient similar to comparative run 20 that used much high levels of the oleic acid. That is, inventive sample 21 achieved such results with about 78% less acid in the fuel sample than comparative run 20. Inventive sample 24 demonstrated similar synergistic improvements using less acidic additive.

Example 4

Wear scar and friction coefficient were also evaluated per the procedure of Example 1 along with a detergent additive package including a detergent, carrier, solvent, and dispersant. In each run, about 37.9 PTB of the same detergent package was used in the evaluations. Results are shown in Table 7 below. When the lubricity additive mixtures are combined with a detergent additive package, the inventive samples (runs 31 and 34) still exhibited a synergistic improvement in average wear scar and friction coefficient because the samples achieved results comparable to the samples with higher acid levels.

TABLE 7

| Wear Scar and Friction Coefficient | | | | | | | |
|---|---|---|---|---|---|---|---|
| Run | Fuel | Oleic Acid, PTB | TOFA, PTB | C16-C18-ASA-NH, PTB | Lubricity Ratio | Average Wear Scar, microns | Average Friction Coefficient |
| 25 | E10 Gasoline | — | — | — | — | 733 | 0.450 |
| 26 | E10 Gasoline | — | — | — | — | 748 | 0.402 |
| 27 | E10 Gasoline | — | — | 2.8 | — | 705 | 0.396 |
| 28 | E10 Gasoline | — | — | 3.6 | — | 693 | 0.374 |
| 29 | E10 Gasoline | 0.8 | — | — | — | 747 | 0.408 |

TABLE 7-continued

Wear Scar and Friction Coefficient

| Run | Fuel | Oleic Acid, PTB | TOFA, PTB | C16-C18-ASA-NH, PTB | Lubricity Ratio | Average Wear Scar, microns | Average Friction Coefficient |
|---|---|---|---|---|---|---|---|
| 30 | E10 Gasoline | 3.6 | — | — | — | 528 | 0.343 |
| 31 | E10 Gasoline | 0.8 | — | 2.8 | 3.5 | 631 | 0.360 |
| 32 | E10 Gasoline | — | 0.8 | — | — | 734 | 0.375 |
| 33 | E10 Gasoline | — | 3.6 | — | — | 538 | 0.321 |
| 34 | E10 Gasoline | — | 0.8 | 2.8 | 3.5 | 624 | 0.352 |

Similar to the testing in Example 3, inventive mixtures 31 and 34 demonstrated a synergistic improvement because each sample achieved wear scar and friction coefficients comparable to samples having much higher levels of acid.

Example 5

This Example evaluated the synergistic effects of a salt of a linear monoacidic lubricity acid combined with a neutral lubricity additive by evaluating wear scar and friction coefficient in a commercially available Tier 3 gasoline with and without the lubricity additive mixtures herein per a modified version of ASTM D6079 using a HFFR gasoline conversion kit as set forth in Example 1. Treat rates of either 95 PTB or 180 PTB of the comparative and inventive fuel additives in gasoline were evaluated. The comparative additive included a core component of a detergent, carrier fluid, solvent and dispersant along with only a neutral lubricity additive of the C16 to C18 ammonial succinimide described in Example 3 (Afton HiTEC®4897). The inventive additive included the same core component (detergent, carrier fluid, solvent, and dispersant), the same neutral lubricity additive (Afton HiTEC®4897), and Duomeen TDO (Akzo Nobel) providing a salt of oleic acid. The inventive samples at the 95 PTB additive treat rate included about 4.92 PTB of the combined neutral lubricity additive and oleic acid salt in the fuel, and the inventive samples at the 180 PTB additive treat rate included about 9.324 PTB of the combined neutral lubricity additive and oleic acid salt in the fuel, which in each case was about 5.2 weight percent of the respective additive package. Both inventive samples have a lubricity weight ratio (that is again the amount of neutral lubricity additive divided by the monoacidic lubricity additive) of about 27.8

Results of this testing is provided below in Table 8 showing two different batches of the E10 fuel (runs 35 to 38 is one batch of fuel and runs 39 to 42 is a different batch of fuel). Wear scar of the base fuel without additives was about 750 microns, and the friction coefficient of the base fuel without additives was about 0.435

TABLE 8

Wear Scar and Friction Coefficient in Gasoline

| Run | Treat Rate | Type | Wear Scar, microns | Friction Coefficient |
|---|---|---|---|---|
| 35 | 95 | Comparative | 611 | 0.323 |
| 36 | 95 | Inventive | 604 | 0.328 |
| 37 | 180 | Comparative | 628 | .350 |
| 38 | 180 | Inventive | 592 | 0.345 |
| 39 | 95 | Comparative | 722 | 0.367 |
| 40 | 95 | Inventive | 714 | 0.368 |

TABLE 8-continued

Wear Scar and Friction Coefficient in Gasoline

| Run | Treat Rate | Type | Wear Scar, microns | Friction Coefficient |
|---|---|---|---|---|
| 41 | 180 | Comparative | 684 | 0.346 |
| 42 | 180 | Inventive | 668 | 0.342 |

Example 6

A further experiment was conducted using the lubricity additives herein within a lubricant and tested on a mini traction machine (MTM) to measure boundary friction coefficient. Results are shown in Table 9 below. This evaluation measured the boundary friction of a 5W30 GF5 lubricant (run 43), the 5W30 GF5 lubricant with a detergent base package (that is, detergent, carrier fluid, solvent, and dispersant) combined with only a neutral lubricity additive (the C16 to C18 ammonia succinimde of Example 3—Afton HiTEC'4897) (run 44), and an inventive additive including the 5W30 GF5 lubricant with the detergent base package (that is, detergent, carrier fluid, solvent, and dispersant), the neutral lubricity additive (the C16 to C18 ammonia succinimde of Example 3—Afton HiTEC®4897) and a salt of a linear monocarboxylic acid (an oleic acid salt provided by Duomeen TDO from Akzo Nobel) (run 45). The reported boundary friction coefficient is an average of two runs and shown in Table 9 below.

The Mini Traction Machine ("MTM"—PCS Instruments) is a bench lubricant test apparatus that measures the friction coefficient and anti-wear film thickness of a lubricant. The MTM test conditions used for this Example were as follows: the first seven scans were recorded at 125° C. at a load or 71N (1.25 Gpa) followed by three scans at 125° C. at a load of 31 N (0.82 GPa). The roll to slide ratio of 50% was used. The last three scans were averaged, and values reported herein. These conditions were found to generate a very good repeatability and reproducibility.

The oil in an engine lubricating process covers three lubrication regimes: elastohydrodynamic, transitional (mixed) and boundary lubrication. Elastohydrodynamic, transitional and boundary lubricating regions in the lubricated system are most conveniently understood by reference to the so-called Stribeck curve. The Stribeck curve describes a plot showing how friction coefficient varies with the operating parameters. Commonly, the mean speed is plotted on the x-axis, and the friction coefficient on the y-axis. Relatively low speeds results in higher friction coefficients in the boundary friction regime. Elastohydrodynamic is found in the high-speed region and is characterized by much lower friction coefficients due to the formation of a thin lubricant film separating the moving components within an engine. The mixed or transitional lubricating region lies in between boundary and elastohydrodynamic. The transitional region is believed to be where asperity contacts begin to occur, reaching a maximum in the boundary region. The lubricant MTM evaluation was determined at seven different individual MTM speeds, which cover the three regions of lubrication. The speeds and lubricating regions were as follows:

| MTM Seed | Lubricating Region |
|---|---|
| 1000+ mm/sec | Elastohydrodynamic |
| 101-1000 mm/sec | Transitional (mixed) |
| 1-100 mm/sec | Boundary |

TABLE 9

MTM Boundary Friction

| Run | Lubricant | Detergent Base Package, % | Neutral Lubricity Additive, % | Monoacidic Additive, % | Boundary Friction Coefficient |
|---|---|---|---|---|---|
| 43 | 5W30 | — | — | — | 0.090676 |
| 44 | 5W30 | 92 | 8 | — | 0.0670 |
| 45 | 5W30 | 92 | 6 | 2 | 0.0665 |

Similar to the wear and friction data in fuels, the inventive lubricity additive mixture (run 45) demonstrates synergy because it provides a lower boundary friction coefficient than run 44 with higher levels of an individual additive.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A gasoline additive providing lubricity, the gasoline additive comprising a lubricity additive mixture of (i) at least one neutral lubricity additive prepared by reacting a hydrocarbyl-substituted succinic anhydride with ammonia wherein the hydrocarbyl substituent includes 8 to 20 carbons and (ii) at least one linear monocarboxylic acid or salt thereof having a carbon chain of 16 to 20 carbons, the linear monocarboxylic acid or salt thereof being saturated, unsaturated, or including mixtures thereof, and when (ii) is the at least one linear monocarboxylic acid, a weight ratio of (i) an amount of the at least one neutral lubricity additive divided by (ii) an amount of the at least one linear monocarboxylic acid is about 0.2 to about 5 and when (ii) is the at least one linear monocarboxylic acid salt, a weight ratio of (i) an amount of the at least one neutral lubricity additive divided by (ii) an amount of the at least one linear monocarboxylic acid salt is about 2 to about 27.8; and about 0.6 to about 10.8 PTB of (i) and about 0.3 to about 1.0 PTB of (ii) are used in a spark-ignitable fuel together.

2. The gasoline additive of claim 1, wherein the hydrocarbyl substituent of the succinic anhydride is a linear or branched C16 to C18 group.

3. The gasoline additive of claim 1, wherein the at least one linear monocarboxylic acid or salt thereof includes a linear carbon chain having 16 to 18 carbon atoms.

4. The gasoline additive of claim 1, wherein the at least one linear monocarboxylic acid or salt thereof is selected from the group consisting of palmitic acid, margaric acid, stearic acid, arachidic acid, oleic acid, palmitoleic acid, linoleic acid, linolenic acid, eleosteric acid, arachidonic acid, linseed oil fatty acid, palm oil fatty acid, rapeseed oil fatty acid, soybean oil fatty acid, sunflower oil fatty acid, tall oil fatty acid, mixtures thereof, and salts thereof.

5. The gasoline additive of claim 1, further comprising a detergent selected from the group consisting of (i) one or more Mannich reaction products formed by condensing a long chain aliphatic hydrocarbon-substituted phenol or cresol with an aldehyde, and an amine, (ii) long chain aliphatic hydrocarbons having an amine or a polyamine attached thereto, (iii) fuel-soluble nitrogen containing salts, amides, imides, succinimides, imidazolines, esters, and long chain aliphatic hydrocarbon-substituted dicarboxylic acids or their anhydrides or mixtures thereof, (iv) polyetheramines; (v) quaternary amines and salts thereof; and (vi) combinations thereof.

6. A fuel comprising a major amount of a spark-ignitable fuel and a minor amount of a lubricity additive mixture, the fuel including (i) about 0.6 to about 10.8 PTB of at least one neutral lubricity additive prepared by reacting a hydrocarbyl-substituted succinic anhydride with ammonia wherein the hydrocarbyl substituent includes 8 to 20 carbons and (ii) about 0.3 PTB to about 1.0 PTB of at least one linear monocarboxylic acid or salt thereof having a carbon chain of 16 to 20 carbons, the linear monocarboxylic acid or salt thereof being saturated, unsaturated, or including mixtures thereof, and when (ii) is the at least one linear monocarboxylic acid, a weight ratio of (i) an amount of the at least one neutral lubricity additive divided by (ii) an amount of the at least one linear monocarboxylic acid is about 0.2 to about 5 and when (ii) is the at least one linear monocarboxylic acid salt, a weight ratio of (i) an amount of the at least one neutral lubricity additive divided by (ii) an amount of the at least one linear monocarboxylic acid salt is about 2 to about 30.

7. The fuel of claim 6, wherein a treat rate of the at lubricity additive mixture in the fuel is at least about 2 PTB.

8. The fuel of claim 6, wherein the hydrocarbyl substituent of the succinic anhydride is a linear or branched C16 to C18 group.

9. The fuel of claim 6, wherein the at least one linear monocarboxylic acid or salt thereof includes a linear carbon chain having 16 to 18 carbon atoms.

10. The fuel of claim 6, wherein the at least one linear monocarboxylic acid or salt thereof is selected from the group consisting of palmitic acid, margaric acid, stearic acid, arachidic acid, oleic acid, palmitoleic acid, linoleic acid, linolenic acid, eleosteric acid, arachidonic acid, linseed oil fatty acid, palm oil fatty acid, rapeseed oil fatty acid, soybean oil fatty acid, sunflower oil fatty acid, tall oil fatty acid, mixtures thereof, and salts thereof.

11. The fuel of claim 6, further comprising a detergent selected from the group consisting of (i) one or more Mannich reaction products formed by condensing a long chain aliphatic hydrocarbon-substituted phenol or cresol with an aldehyde, and an amine, (ii) long chain aliphatic hydrocarbons having an amine or a polyamine attached thereto, (iii) fuel-soluble nitrogen containing salts, amides, imides, succinimides, imidazolines, esters, and long chain aliphatic hydrocarbon-substituted dicarboxylic acids or their anhydrides or mixtures thereof, (iv) polyetheramines; (v) quaternary amines and salts thereof; and (vi) combinations thereof.

12. A method of reducing wear in a gasoline engine comprising operating the gasoline engine with a fuel including a major amount of gasoline and a minor amount of a lubricity additive mixture, the fuel including (i) about 0.6 to about 10.8 PTB of at least one neutral lubricity additive prepared by reacting a hydrocarbyl-substituted succinic anhydride with ammonia wherein the hydrocarbyl substituent includes 8 to 20 carbons and (ii) about 0.3 PTB to about 1.0 PTB of at least one linear monocarboxylic acid or salt thereof having a carbon chain of 16 to 20 carbons, the linear monocarboxylic acid or salt thereof being saturated, unsaturated, or including mixtures thereof, and when (ii) is the at least one linear monocarboxylic acid, a weight ratio of (i) an amount of the at least one neutral lubricity additive divided by (ii) an amount of the at least one linear monocarboxylic acid is about 0.2 to about 5 and when (ii) is the at least one linear monocarboxylic acid salt, a weight ratio of (i) an amount of the at least one neutral lubricity additive divided by (ii) an amount of the at least one linear monocarboxylic acid salt is about 2 to about 30.

13. The method of claim 12, wherein a treat rate of the lubricity additive mixture in the fuel is at least about 2 PTB.

14. The method of claim 12, wherein the hydrocarbyl substituent of the succinic anhydride is a linear or branched C16 to C18 group.

15. The method of claim 12, wherein the linear monoacidic lubricity additive or salt thereof includes a linear carbon chain having 16 to 18 carbon atoms.

16. The method of claim 12, wherein the linear monoacidic lubricity additive or salt thereof is selected from the group consisting of palmitic acid, margaric acid, stearic acid, arachidic acid, oleic acid, palmitoleic acid, linoleic acid, linolenic acid, eleosteric acid, arachidonic acid, linseed oil fatty acid, palm oil fatty acid, rapeseed oil fatty acid, soybean oil fatty acid, sunflower oil fatty acid, tall oil fatty acid, mixtures thereof, and salts thereof.

17. The method of claim 12, wherein the reduced wear is one of about 15 to about 30 percent reduction in wear scar, about 25 to about 35 reduction in friction coefficient, or both as measured by the HFRR test of modified ASTM D6079.

18. The gasoline additive of claim 1, wherein the hydrocarbyl substituent of the hydrocarbyl-substituted succinic anhydride has 16 to 18 carbons and the at least one linear monocarboxylic acid or salt thereof is selected from oleic acid, TOFA, salts thereof, or combinations thereof.

19. The fuel of claim 6, wherein the hydrocarbyl substituent of the hydrocarbyl-substituted succinic anhydride has 16 to 18 carbons and the at least one linear monocarboxylic acid or salt thereof is selected from oleic acid, TOFA, salts thereof, or combinations thereof.

20. The fuel of claim 19, wherein the at least one linear monocarboxylic acid or salt thereof is an oleic acid salt and the fuel includes about 4 PTB to about 10 PTB of the combined neutral lubricity additive and the oleic acid salt.

21. The method of claim 12, wherein the hydrocarbyl substituent of the hydrocarbyl-substituted succinic anhydride has 16 to 18 carbons and the at least one linear monocarboxylic acid or salt thereof is selected from oleic acid, TOFA, salts thereof, or combinations thereof.

22. The method of claim 21, wherein the at least one linear monocarboxylic acid or salt thereof is an oleic acid salt and the fuel includes about 4 PTB to about 10 PTB of the combined neutral lubricity additive and the oleic acid salt.

23. The gasoline additive of claim 1, wherein the hydrocarbyl substituent of the succinic anhydride is a C14 to C18 hydrocarbyl group.

24. The fuel of claim 6, wherein the hydrocarbyl substituent of the succinic anhydride is a C14 to C18 hydrocarbyl group.

25. The gasoline additive of claim 1, wherein the weight ratio of (i) an amount of the at least one neutral lubricity additive divided by (ii) an amount of the at least one linear monocarboxylic acid salt is about 2.0 to about 20, and about 0.6 to about 10 PTB of (i) and about 0.3 to about 0.8 PTB of (ii) are used in a spark-ignitable fuel together.

26. The fuel of claim 6, wherein the fuel includes about 0.6 to about 10 PTB of (i) and about 0.3 to about 0.8 PTB of (ii), and the weight ratio of (i) an amount of the at least one neutral lubricity additive divided by (ii) an amount of the at least one linear monocarboxylic acid salt is about 2 to about 20.

27. The method of claim 12, wherein the fuel includes about 0.6 to about 10 PTB of (i) and about 0.3 to about 0.8 PTB of (ii), and the weight ratio of (i) an amount of the at least one neutral lubricity additive divided by (ii) an amount of the at least one linear monocarboxylic acid salt is about 2 to about 20.

* * * * *